US005934723A

United States Patent [19]

Schmalz

[11] Patent Number: 5,934,723

[45] Date of Patent: Aug. 10, 1999

[54] VACUUM HANDLING APPARATUS

[75] Inventor: Kurt Schmalz, Dornstetten, Germany

[73] Assignee: J. Schmalz GmbH, Glatten, Germany

[21] Appl. No.: 08/834,200

[22] Filed: Apr. 14, 1997

[30] Foreign Application Priority Data

Apr. 12, 1996 [DE] Germany ..... 196 14 479

[51] Int. Cl.[6] ..... B66C 1/02

[52] U.S. Cl. ..... 294/64.1; 414/627

[58] Field of Search ..... 294/64.1–65; 414/627, 414/737, 752; 901/40; 271/94, 96, 103

[56] References Cited

U.S. PATENT DOCUMENTS

| | | | |
|---|---|---|---|
| 2,995,359 | 8/1961 | Gulick | 271/103 |
| 3,743,340 | 7/1973 | Williamann | 414/627 |

FOREIGN PATENT DOCUMENTS

| | | |
|---|---|---|
| 0 373 840 | 6/1990 | European Pat. Off. . |
| 0 493 979 A1 | 7/1992 | European Pat. Off. . |
| 0 509 115 A1 | 10/1992 | European Pat. Off. . |
| 0 590 554 A1 | 4/1994 | European Pat. Off. . |
| 31 34 420 C2 | 3/1990 | Germany . |
| 2 200 615 A | 8/1988 | United Kingdom . |

*Primary Examiner*—Dean Kramer
*Attorney, Agent, or Firm*—Jones, Tullar & Cooper, P.C.

[57] ABSTRACT

The present invention relates to a vacuum handling apparatus, having a suction gripper device which can be connected by means of a lifting hose to a vacuum-creating device and can be placed upon an object, in order to suck up the object for lifting or conveyance. The apparatus has a control valve for controlling the vacuum prevailing in the interior of the suction gripper device and in the lifting hose, in order to lift or lower the suction gripper device with a sucked-up object or the empty suction gripper device, or to deposit a sucked-up object. In order to make this apparatus easier to operate, without making its structure complex, the apparatus is designed in such a way that the control valve has a valve disc which can be rotated about a fixed axis relative to a bearing surface and has at least one control aperture, which control disc can be rotated by means of a rotary handle in such a way that the control aperture clears an increasing or decreasing effective flow cross-section with a ventilation aperture in the bearing surface, and further that the control disc can be lifted off the bearing surface in order to release a sucked-up object, or that a further ventilation aperture which can be closed or opened by a swivelling ventilation flap is provided in a wall of the apparatus.

15 Claims, 5 Drawing Sheets

VACUUM HANDLING APPARATUS

The present invention relates to a vacuum handling apparatus, having a suction gripper device which can be connected by means of a lifting hose to a vacuum-creating device and can be placed upon an object for lifting or conveyance, in order to suck up the object, and having a control valve for controlling the vacuum prevailing in the interior of the suction gripper device and in the lifting hose, in order to lift or to lower the suction gripper device with a sucked-up object or the empty suction gripper device, or to deposit a sucked-up object.

BACKGROUND

Such an apparatus, which is also often called a vacuum lifter, is known. When an object sucked up on the suction gripper device is to be lifted off the ground, a control valve is moved in the closing direction, so that the clear cross-sectional area for the incoming air is less and the flow resistance thus is greater, so that with uniform suction performance of the vacuum-creating device, which can be a suction fan or the like, a bellows-like lifting hose contracts and lifts the suction gripper device together with the sucked-up object off the ground against the effect of weight. If the object is to be deposited again, the control valve is adjusted in the opening direction, so that the clear cross-sectional area increases again and more air can consequently flow into the interior of the suction gripper device or into the lifting hose, which causes the lifting hose to expand again because of the downward directed weight and the suction gripper device to be lowered with the sucked-up object.

European Patent 0493 979 A 1 discloses a suction gripper device with a surrounding oval handle, the control valve of which is formed by a swivelling flat flap which is attached to a U-shaped stirrup, which in turn is articulated in such a way that it can swivel about an axis running parallel to the plane of the handle. The U-shaped stirrup is operated by the fingertips of a hand gripping around the handle. If the stirrup is swivelled with the fingertips in the direction towards the handle, the valve flap is swung in front of a flow aperture, so that the effective flow cross-section of the latter is reduced. In order to be able to deposit a sucked-up body, the U-shaped stirrup must be pressed down fully, so that the swivelling valve flap fully clears the flow cross-section, which is constantly increasing in size in the opening direction. Operating errors often occur, for example when a user of the apparatus accidentally moves the stirrup too far downwards and the suction gripper device together with the sucked-up object is lowered very rapidly. A further disadvantage of the known apparatus is that the U-shaped swivelling stirrup is very easily shifted accidentally. If, for example, an object is being lifted and is to be held at a specific height for a short period, that can be set by means of the stirrup, but there is a risk of the stirrup being shifted when the handle is released, and of a lifting or lowering movement occurring.

European Patent 0590 554 A 1 discloses a further vacuum lifting apparatus which likewise has a swivelling valve flap arrangement, the valve flap preferably being movable under spring load into an initial position, in which it completely closes a first flow aperture, and opens a second, smaller flow aperture. In this position the level of the vacuum inside the suction gripper device or the lifting hose is set by a static valve which is, however, adjustable during operation and controls the flow cross-section of the second aperture. By setting this valve it is therefore possible to hold a lifted object at a desired height. The arrangement described is, however, expensive and has the disadvantages described above, in particular when the sucked-up object is being deposited.

SUMMARY OF THE INVENTION

An object of the present invention is therefore to improve a vacuum handling apparatus of the type mentioned above in such a way that it is easier to operate, yet does not require a complex construction.

This object is achieved according to the present invention in a vacuum handling apparatus of the abovementioned type by the fact that the control valve has a valve disc which can be rotated about a fixed axis relative to a bearing surface and has at least one control aperture, which valve disc can be rotated by means of a rotary handle in such a way that the control aperture clears an increasing or decreasing effective flow cross-section with a ventilation aperture in the bearing surface, and in that the control disc can be lifted off the bearing surface in order to release a sucked-up object, or in that a further ventilation aperture which can be closed or opened by a swivelling ventilation flap is provided in a wall of the apparatus.

Owing to the fact that the control valve according to the present invention is formed by a valve disc which is rotatable by means of a rotary handle, it is possible, on the one hand, to achieve a very space-saving arrangement, and there is no risk of a flow cross-section which has been set by rotation of the valve disc becoming accidentally shifted. This arrangement already merits independent inventive significance.

As a further development of the present inventive idea, the valve disc can be lifted off its bearing surface, so that the flow cross-section can be increased for a short time when a sucked-up object is to be deposited. The control disc can be raised, for example, against a spring force by a separate setting element, such as an adjusting lever or the like. However, it is also conceivable for the rotary valve disc to interact with a contact slope when it is rotated in the opening direction, so that it can be lifted from its bearing surface.

Alternatively, according to the present invention it is possible for a further ventilation aperture which can be closed or opened by a swivelling ventilation flap to be provided in a wall of the apparatus, which flap can be swung briefly into a position which clears the aperture, in order to deposit or release a sucked-up object. This swivelling ventilation flap is then preferably pretensioned in the closing direction.

For the handling of, for example, porous objects, it may prove advantageous if the control aperture, which preferably extends in the circumferential direction of the control disc, and the ventilation aperture interacting therewith in the wall of the apparatus have a release area of fairly large cross-section. It can then be sufficient to turn the control disc into this release area, in order to be able to release the suction gripper device from the object which has been deposited on the ground.

In a very particularly advantageous embodiment of the present invention, in which an additional ventilation aperture is provided, the ventilation flap which closes or clears the ventilation aperture is actuated by rotating the control disc.

For this purpose, from a particular opening angle onwards the control disc is in rotational synchronization, which is variable per se, with the swivelling ventilation flap. The control flap can have, for example, a carrier element which projects in the radial direction and produces a swivelling movement of the ventilation flap.

According to a further inventive idea, a stop which limits the rotation of the control disc in the opening direction is provided.

According to the inventive idea mentioned at the beginning, a ramp means which interacts with the control disc can be provided, which ramp means lifts the control disc off the bearing surface during rotation in the opening direction.

Further features and advantages of the present invention will become apparent from the appended drawings and the description which follows of an advantageous embodiment of the present invention.

DESCRIPTION OF THE PREFERRED EMBODIMENTS

Figure 1:
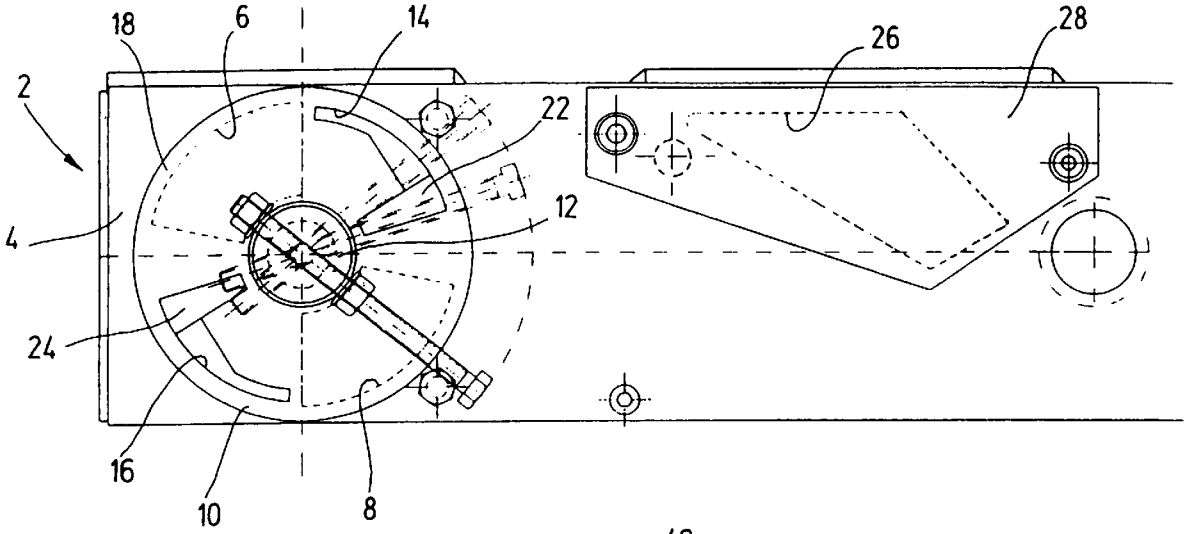
FIG. 1 shows a first embodiment of an only partially illustrated suction gripper device of a vacuum handling apparatus according to the present invention.

FIG. 1 shows a partially illustrated suction gripper device 2 in diagrammatic side view. At the bottom side of the suction gripper device 2 in FIG. 1 there are suction apertures onto which an object to be lifted can be sucked. A lifting hose (not shown) can be connected at the top side, which hose is in flow connection with a suction fan. Ventilation apertures 6 and 8, which are covered by a rotary valve disc 10, are provided in a side wall 4, for ventilation of the interior of the suction gripper device 2. The valve disc 10 can be rotated about a fixed axis of rotation 12 and has, extending in the circumferential direction, control slits or apertures 14 and 16 which can be aligned so that they coincide with the ventilation apertures 6 and 8, by rotating the control disc 10, so that an effective flow cross-section or a flow connection between the interior of the suction gripper device 2 and the environment is produced. However, the control slits 14, 16 can also be taken out of alignment with the ventilation apertures 6, 8 by appropriate rotation of the control disc 10, so that the control disc 10 closes the ventilation apertures 6, 8 and rests against its bearing surface 18 on the side wall 4, thereby forming a seal.

If the control disc 10 is rotated anticlockwise, which can be achieved by turning a handle 20 (FIG. 3) which is non-rotationally connected flush with the axis of rotation 12, the effective flow cross-section between the ventilation apertures 6, 8 and the control slits 14, 16 is increased, and the vacuum in the interior of the suction gripper device 2 is reduced, so that the suction gripper device 2 is lowered.

The control slits 14, 16 extending in the circumferential direction merge in the opening direction into a release aperture 22, 24 respectively extending in the radial direction. When the control disc 10 is rotated so far in the opening direction that the release aperture 22, 24 respectively goes into an aligned arrangement with the ventilation apertures 6, 8, the flow cross-section increases intermittently and if there is sufficient porosity and/or weight the sucked-up object can be released.

In addition to the arrangement described above, a further ventilation aperture 26 is provided in the side wall 4, but in this embodiment it is closed by a cover plate 28, which is screwed onto the side wall 4.

In order to ensure a certain and rapid release of a sucked-up object, the control disc 10 can additionally be raised from its bearing surface 18, in order to provide a large flow cross-section for a short time, for ventilating the hose lifter system.

Figure 2:
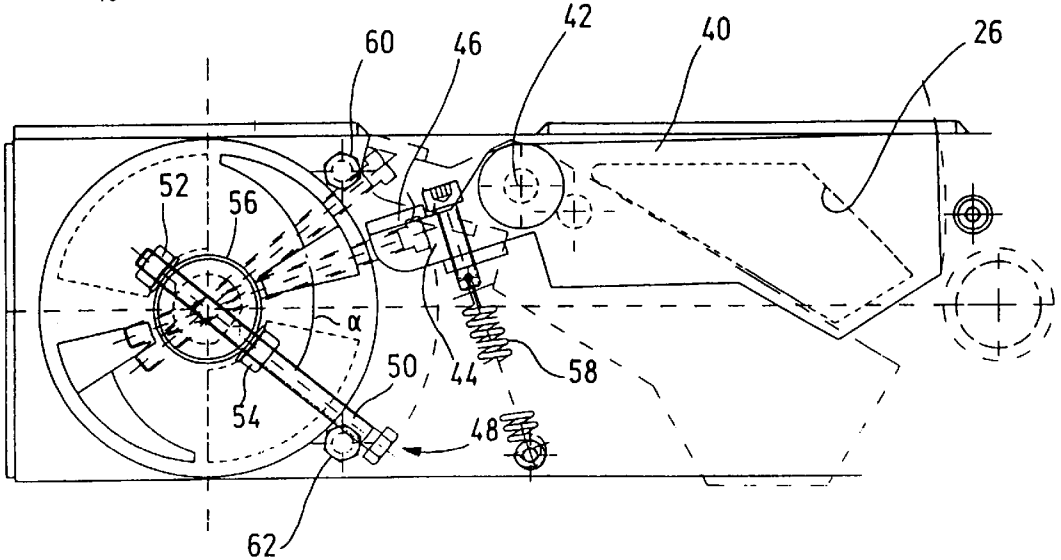
FIG. 2 shows a further embodiment of a suction gripper device according to the present invention with an additional ventilation aperture.
Figure 3:
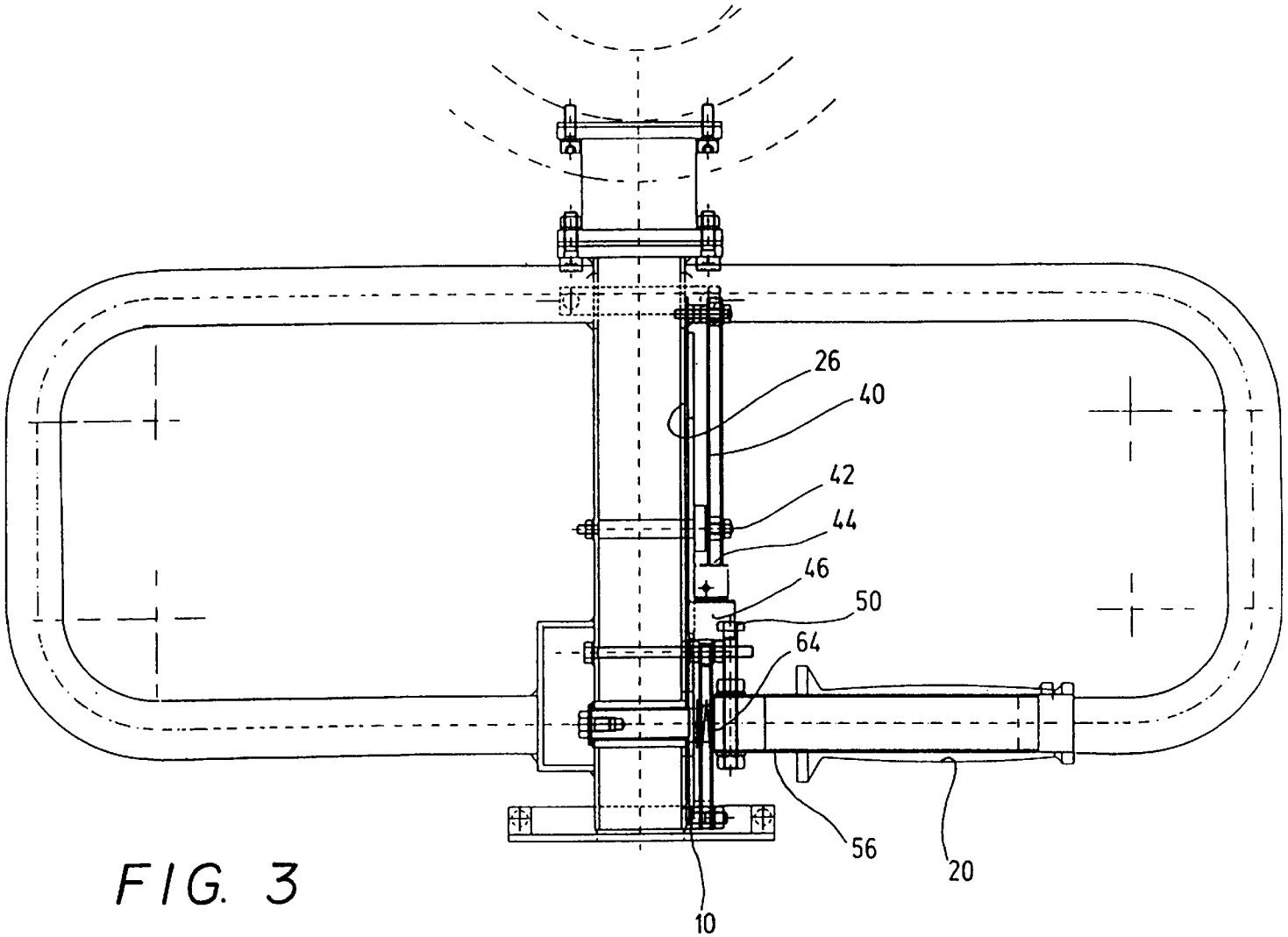
FIG. 3 shows a sectional view of the suction gripper device according to FIG. 2, at right angles to the plane of an drawing in FIG. 2.
Figure 4:
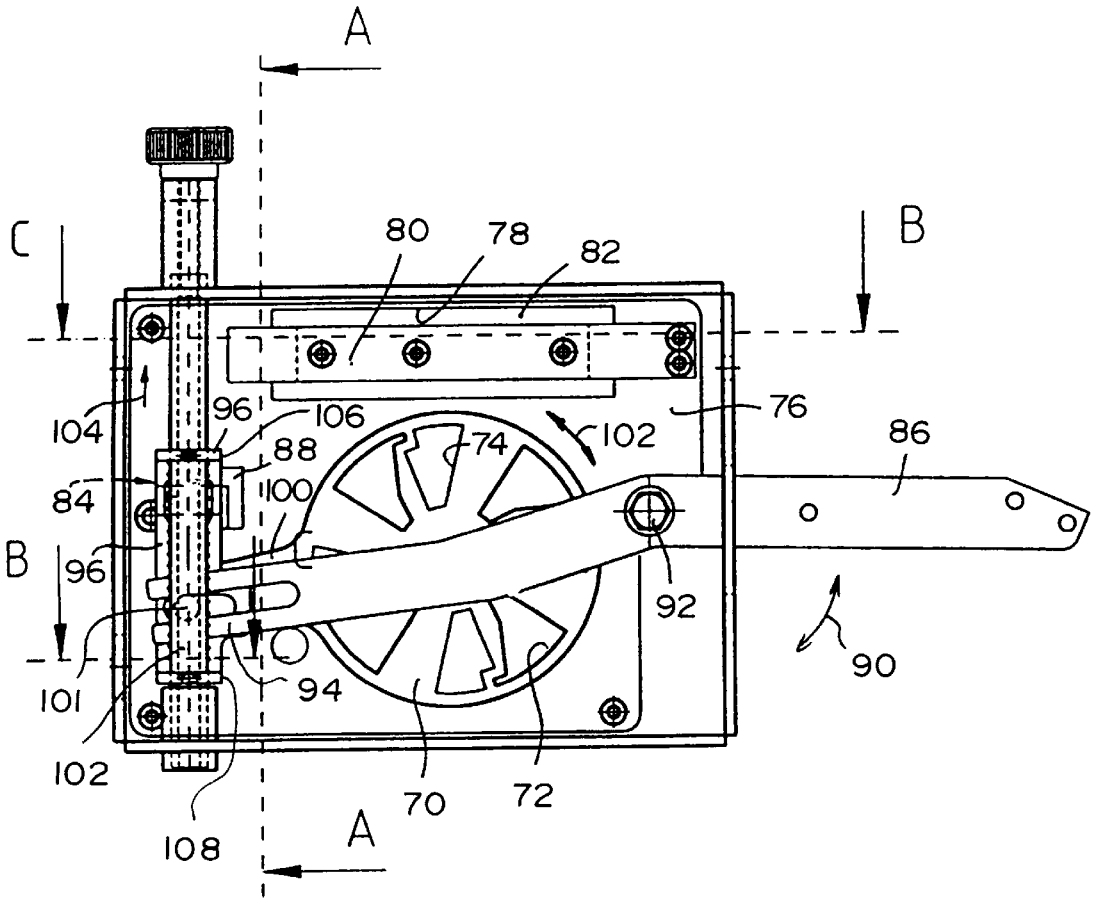
FIGS. 4–7 show a further embodiment of a suction gripper device according to the present invention with additional ventilation apertures.
Figure 5:
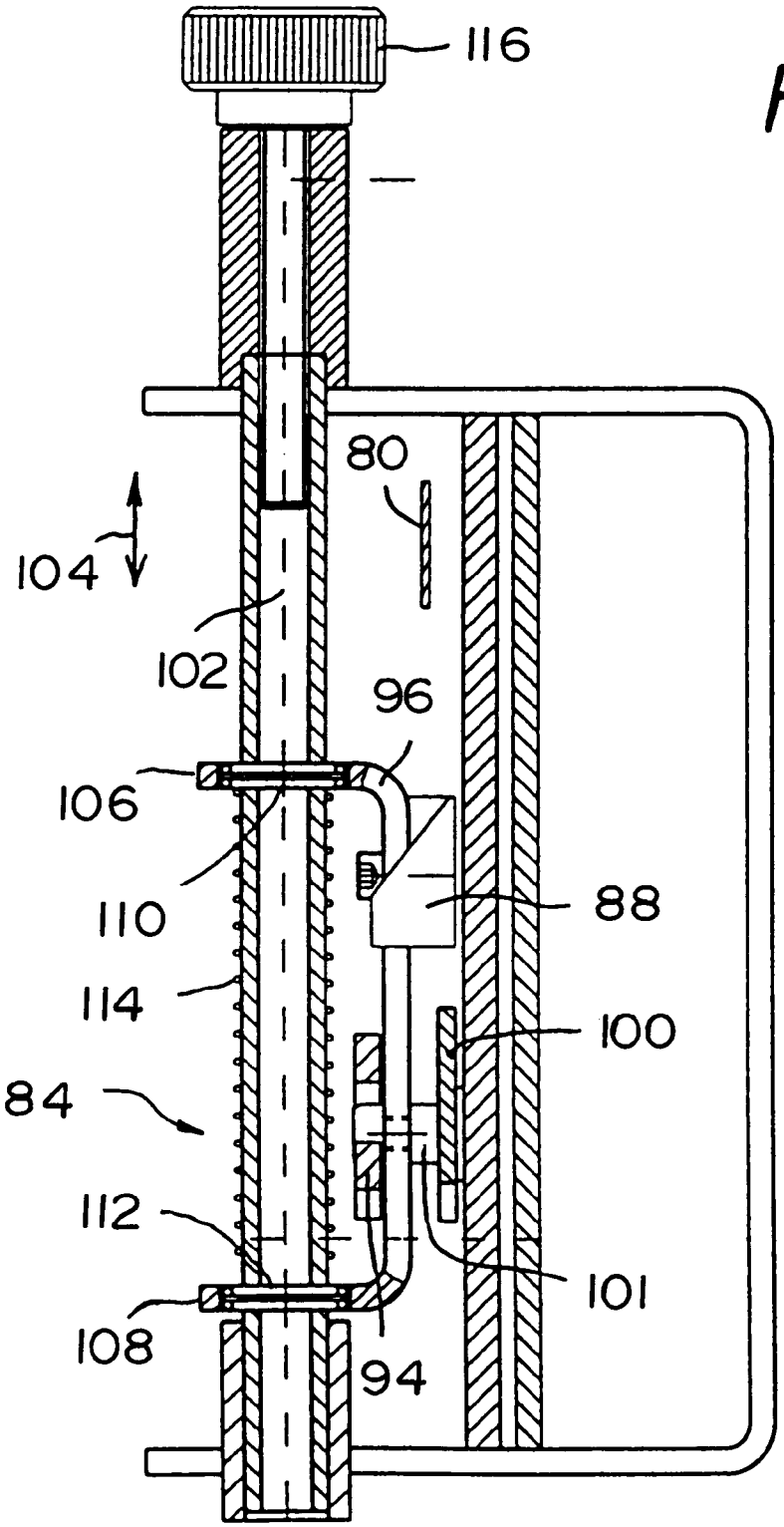
Figure 6:
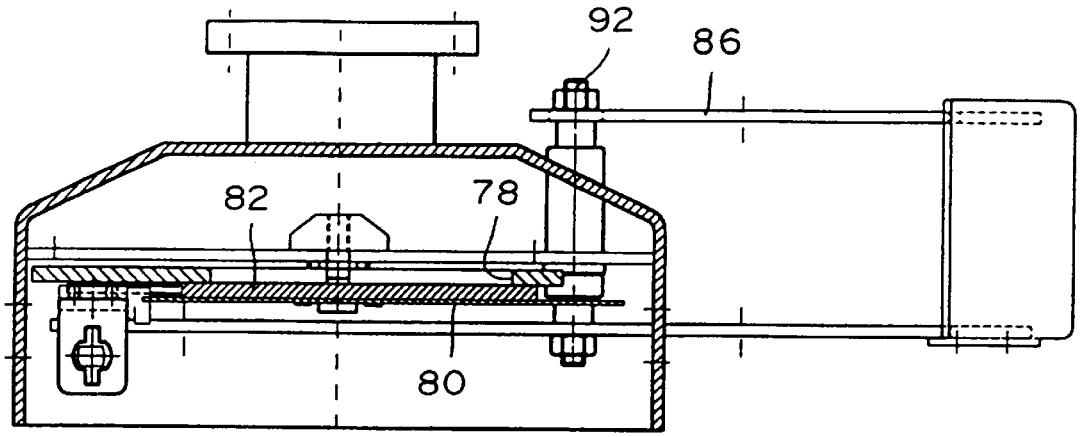
Figure 7:
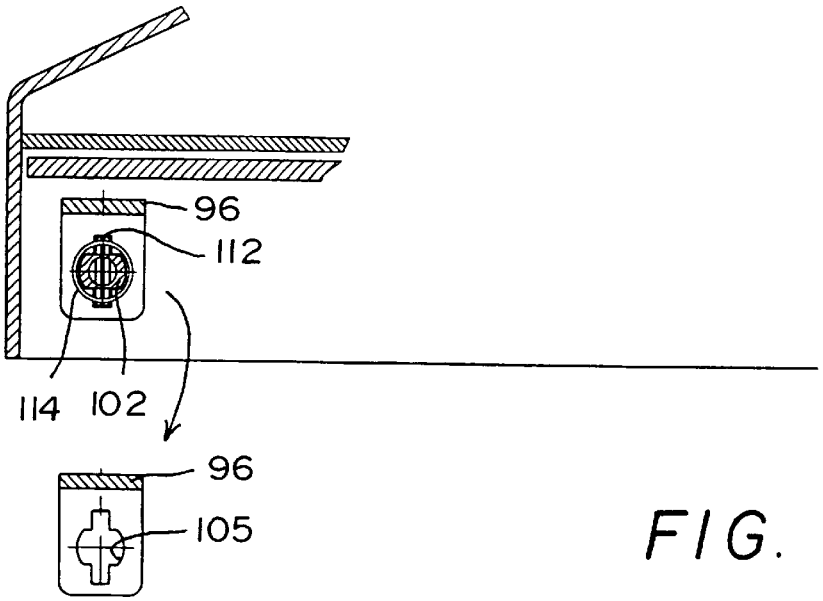

In a further advantageous embodiment, as illustrated in FIG. 2, the further ventilation aperture 26 can be opened or closed as desired by a cover plate 40 which can be swivelled about an axis 42. The cover plate 40 has an operating leg 44, situated in the same plane, with a stop area 46 which is bent at a right angle to the plane of the drawing. A radial carrier element 48 of the control disc 10 can rest against this stop area 46 when the control disc is turned in the opening direction through a specific aperture angle $\alpha$ by means of the handle 20. The carrier element 48 is formed in a particularly advantageous way by a screw 50 which is fitted by means of two nuts 52, 54 of a flange-like tubular section 56 running coaxially with the handle 20 and connected non-rotationally to the disc 10 (FIG. 3). Therefore, when the control disc 10 is turned beyond the abovementioned aperture angle $\alpha$, the screw strikes against the stop area 46 and swings the cover plate 40 about its swivel axis 42, so that the further ventilation aperture 26, which has a larger flow cross-section than the control slit 14 or 16, is opened. The nose lifter system is then ventilated for a short time, thereby ensuring a certain release of a sucked-up workpiece. The cover plate 40 is pretensioned in the closing direction by a spring 58, so that when the handle 20 is released the cover plate 40 is moved into its position which closes the further ventilation aperture 26 and at the same time also turns back the control disc 10 into its position indicated by the aperture angle $\alpha$.

Instead of or in addition to the spring 58, the operating leg 44 can be provided with a further stop area (not shown) which interacts with the screw 50, and by means of which the cover plate is swung in the closing direction when the control disc is rotated in the closing direction again.

In addition, two stop elements 60, 62 are provided, interacting with the screw 50 extending in the radial direction, which elements limit the rotation of the control disc 10 in the opening and closing direction.

Finally, FIG. 3 shows the arrangement of the rotary handle 20 on the circumferential and closed handling stirrup of the vacuum handling apparatus. It can also be seen that the control disc 10 is pressed by a spring 64 against its bearing surface 18 to form a seal.

FIGS. 4 to 7 show a further embodiment of the vacuum handling apparatus according to the present invention. It can be seen from the figures that a rotary control disc 70 with control apertures 72 is provided, which control disc can be rotated in such a way that its control apertures 72 can clear an increasing or decreasing effective flow cross-section with ventilation apertures 74 in a wall 76. In addition, a further ventilation aperture 78, which can be covered by a ventilation flap 80 made from a resilient sheet with a sealing covering 82, is provided. An adjusting element, indicated in its entirety by reference number 84, which interacts with a handle 86 and produces both a rotation of the control disc 70 and a swivelling or deflection of the resilient ventilation flap 80 into a position which opens the ventilation aperture 78, is also provided.

For this purpose, the adjusting element 84 comprises a wedge-shaped ramp means 88. When the handle 86 is turned in the direction of the arrow 90 about an axis 92, its fork-shaped end 94 moves a U-shaped stirrup 96 upwards in FIG. 4. The control disc 70 is likewise connected to the stirrup 96 by means of a fork-shaped, radially outward projecting strip 100 and a carrier bolt 101, and is therefore, rotated in the direction of the arrow 102.

The ramp means 88 is also moved together with the stirrup 96 in the direction towards the ventilation flap 80. The ramp means 88 grips under the ventilation flap 80 and lifts it off the ventilation aperture 78 when the handle 86 is turned sufficiently far downwards.

The stirrup 96 can be slid on a guide column 102 in the direction of the arrow 104. The guide column 102 engages through apertures 105 with legs 106, 108 of the stirrup 96. The apertures 105 are formed in such a way that the legs 106, 108 can be moved beyond stop means 110, 112 fixed in a stationary manner on the guide column 102. A compression spring 114 rests against the stop means 110, 112 in the region between the legs 106, 108. Therefore, when the handle 86 slides the stirrup 96 in the direction of the arrow 104, the leg 106 of the stirrup 96 is moved beyond the stop means 110, but the compression spring 114 still remains supported against the stop means 110. However, the other end of the spring is simultaneously carried along by the leg 108. The compression spring 114 is therefore tensioned and builds up a restoring force for the stirrup 96. The stirrup 96 could be moved in a corresponding manner in the other direction 104.

The position of the guide column 102, which is non-circular in cross-section, can be adjusted in the direction of the arrow 104 by means of a knurled screw 116. An initial position of the stirrup 96, and consequently a specific rotated position of the control disc 70, and therefore of the so-called suspension state of the suction gripper device, is set in this way.

I claim:

1. A vacuum handling apparatus connected by a lifting hose to a source of vacuum, comprising:

a suction gripper device for lifting or conveying an object using vacuum, said suction gripper device including an interior to which a vacuum is applied from the vacuum source and through the lifting hose and a bearing surface having a ventilation aperture; and a control valve for controlling the vacuum in the interior of said suction gripper device and the lifting hose, thereby controlling the lifting or lowering of said suction gripper device with or without a sucked-up object, wherein said control valve includes: a valve disc, which is rotated about a fixed axis relative to said bearing surface; means for lifting off said valve disc from said bearing surface; at least one control aperture; and a rotary handle for rotating said valve disc in such a way that said control aperture clears one of an increasing and decreasing effective flow cross-section with said ventilation aperture in said bearing surface, wherein said valve disc can be lifted off said bearing surface in order to release a sucked-up object.

2. The apparatus as defined in claim 1, wherein said valve disc is lifted off said bearing surface by rotation in the opening direction.

3. The apparatus as defined in claim 1, wherein said control aperture extends in the circumferential direction of said valve disc.

4. The apparatus as defined in claim 1, wherein said control aperture merges in the opening direction of said valve disc into a release area of larger cross-section, in order to release a sucked-up object from said suction gripper device.

5. The apparatus as defined in claim 1, further comprising:

a stop provided for limiting the rotation of said valve disc in the opening direction.

6. A vacuum handling apparatus connected by a lifting hose to a source of vacuum, comprising:

a suction gripper device for lifting or conveying an object using vacuum, said suction gripper device including an interior to which a vacuum is applied from the vacuum source, and through the lifting hose, and a bearing surface having a ventilation aperture and a further ventilation aperture, and a swivelling ventilation flap; and a control valve for controlling the vacuum in the interior of said suction gripper device and the lifting hose, thereby controlling the lifting or lowering of said suction gripper device with or without a sucked-up object, wherein said control valve includes: a valve disc, which is rotated about a fixed axis relative to said bearing surface; at least one control aperture; and a rotary handle for rotating said valve disc in such a way that said control aperture clears one of an increasing and decreasing effective flow cross-section with said ventilation aperture in said bearing surface, wherein said further aperture is closed or opened by said swivelling ventilation flap in order to release a sucked-up object.

7. The apparatus as defined in claim 6, wherein said control aperture extends in the circumferential direction of said valve disc.

8. The apparatus as defined in claim 6, wherein said control aperture merges in the opening direction of said valve disc into a release area of larger cross-section, in order to release a sucked-up object from said suction gripper device.

9. The apparatus as defined in claim 6, wherein said swivelling ventilation flap is actuated in the opening direction by rotating said valve disc.

10. The apparatus as defined in claim 6, wherein said swivelling ventilation flap is pretensioned in the closing direction.

11. The apparatus as defined in claim 6, further comprising:

a carrier element which projects in the radial direction beyond said valve disc, and wherein said swivelling ventilation flap is actuated by said carrier element.

12. The apparatus as defined in claim 6, further comprising:

a stop provided for limiting the rotation of said valve disc in the opening direction.

13. The apparatus as defined in claim 6, wherein said swivelling ventilation flap comprises a resilient material.

14. The apparatus as defined in claim 6, wherein said swivelling ventilation flap comprises a resilient sheet with a sealing material.

15. The apparatus as defined in claim 6, further comprising:

wedge-shaped ramp means, and wherein said swivelling ventilation flap into a position which opens said ventilation aperture by said wedge-shaped ramp means.

* * * * *